US006595717B2

(12) United States Patent
Newman

(10) Patent No.: US 6,595,717 B2
(45) Date of Patent: Jul. 22, 2003

(54) ROAD GULLY OR INSPECTION COVER ASSEMBLY

(76) Inventor: Frederick George Newman, Airds Bay, Sandgreen, Gatehouse of fleet, Castle Douglas GF7 2DU (GB)

( * ) Notice: Subject to any disclaimer, the term of this patent is extended or adjusted under 35 U.S.C. 154(b) by 0 days.

(21) Appl. No.: 09/836,509

(22) Filed: Apr. 18, 2001

(65) Prior Publication Data

US 2001/0033769 A1 Oct. 25, 2001

(30) Foreign Application Priority Data

Apr. 20, 2000 (GB) ..... 0009951

(51) Int. Cl.[7] ..... E02D 29/14
(52) U.S. Cl. ..... 404/26; 404/25; 52/20
(58) Field of Search ..... 404/25, 26; 52/19, 52/20

(56) References Cited

U.S. PATENT DOCUMENTS

| | | | | | |
|---|---|---|---|---|---|
| 3,408,778 | A | * | 11/1968 | Mason | 52/20 |
| 4,197,031 | A | * | 4/1980 | Hild | 404/26 |
| 4,591,290 | A | * | 5/1986 | Prescott | 404/25 |
| 4,906,128 | A | * | 3/1990 | Trudel | 404/26 |
| 5,044,818 | A | * | 9/1991 | Pritchard | 404/26 |
| 5,732,512 | A | * | 3/1998 | Ueno et al. | 52/19 |
| 5,941,025 | A | * | 8/1999 | Chang | 52/20 |

FOREIGN PATENT DOCUMENTS

| | | |
|---|---|---|
| CH | 435 135 | 10/1967 |
| CH | 459 084 | 6/1968 |
| CH | 581 236 | 10/1976 |
| FR | 2 636 085 | 3/1990 |
| GB | 789542 | 1/1958 |

* cited by examiner

*Primary Examiner*—Heather Shackelford
*Assistant Examiner*—Sunil Singh
(74) *Attorney, Agent, or Firm*—Larson & Taylor PLC

(57) ABSTRACT

A road gully or inspection cover assembly comprises an outer frame having an upstanding outer wall and integrally formed support structure extending inwardly of the lower regions of the outer wall over part at least of the peripheral extent of the outer wall, a first temporary inner frame for location within the outer frame, the outer frame and the first temporary inner frame co-operating to support a cover for the assembly in a first, lowermost position associated with the base course level of the road, and a second inner frame which, on removal of the first inner frame from within the outer frame, can be located within the outer frame to support the cover at a higher position associated with the wearing course level of the road.

11 Claims, 8 Drawing Sheets

ROAD GULLY OR INSPECTION COVER ASSEMBLY

BACKGROUND OF THE INVENTION

This invention relates to a road gully or inspection cover assembly, and more particularly to such an assembly that permits ready adjustment of the vertical position of the cover of the assembly.

It is a necessary part of the construction of new roads to incorporate water gullies and manholes therein all of which have to be covered, the covers eventually needing to be at the finished level of the road.

Common practice is initially to construct a road to a base course level and thereafter to apply a wearing course of substantial thickness to complete the road.

The gullies and manholes are incorporated prior to application of the wearing course, and invariably extend above the base course with their covers located at a level anticipating that of the final wearing course.

There is often a considerable period of time, particularly in new housing estates, between laying of base courses and wearing courses, and this can create a number of problems.

As the covers project above the surface of the base course by the thickness of the wearing course, they constitute serious obstacles to vehicles with low clearance as well as to pedestrians. They can cause damage to, and can themselves be damaged by, vehicles, particularly road cleaning vehicles incorporating mechanical front shovels. In such situations, the assemblies, or at least the covers thereof, often have to be replaced and the associated manhole or gully cleared of rubble to prevent blockage.

Additionally, the finished level of the water gullies, being above that of the base course prior to the application of the wearing course, results in the accumulation of large pools of water on the roads during wet weather.

It has been proposed, for example in my European patent no. 0715028, to provide a road gully or inspection cover assembly the position of the cover of which can be adjusted to accommodate the difference in levels between the base course and the wearing course of the road.

More particularly, the known assembly comprises a fixed outer frame and an adjustable inner frame slidably supported in the outer frame and capable of being located at any position between a lowermost position and an uppermost position, the inner frame supporting the cover of the assembly whereby the cover can initially be located at the base course level of the road, and subsequently raised and located at the wearing course level of the road.

Such an assembly is suitable for situations in which the depth of the wearing course is within certain defined limits whereby strict regulations relating to the extent of overlap of the components of the assembly can be satisfied.

In particular, it is necessary to provide a minimum 50 mm vertical overlap of the cover with its supporting frame, and a minimum 50 mm overlap between the inner and outer frames.

The standard depth of the outer frame is 100 mm, the thickness of the base plate of the outer frame is 6 mm, and the recommended thickness of the wearing course is 40 mm. The overall relationship between the inner and outer frames of this known assembly is such as to provide a maximum adjustability between the lowermost and uppermost positions of the inner frame, and therefore the maximum depth of wearing course that can be accommodated by the assembly, of 44 mm.

SUMMARY OF THE INVENTION

It would be desirable to be able to provide a road gully or inspection cover assembly capable of accommodating thicker wearing courses than heretofore, whilst still satisfying British Standard regulations.

According to the present invention there is provided a road gully or inspection cover assembly comprising an outer frame having an upstanding outer wall and integrally formed support means extending inwardly of the lower regions of the outer wall over part at least of the peripheral extent of said outer wall, a first temporary inner frame for location within the outer frame, the outer frame and the first temporary inner frame co-operating to support a cover for the assembly in a first, lowermost position associated with the base course level of the road, and a second inner frame which, on removal of the first inner frame from within the outer frame, can be located within the outer frame to support the cover at a higher position associated with the wearing course level of the road.

There may be a plurality of second inner frames, one associated with each of a number of different higher positions.

Alternatively, the position of the second inner frame relative to the outer frame may be vertically adjustable, for example by providing selectively variable support means reacting between the outer frame and the underside of the second inner frame.

In a first embodiment of the invention, the outer frame is of upwardly-open channel shape in transverse section over said part at least of the peripheral extent of the outer wall thereof, the inner wall of the section comprising said support means, the lowermost position of the cover being determined by abutment of the cover with the inner wall of the channel section, the first temporary inner frame surrounding the cover in its lowermost position to close the hollow interior of the outer frame, the second inner frame being received within the channel section of the outer frame to determine the higher position of the cover.

In a second embodiment of the invention, the outer frame is of substantially L-shape in transverse section over said part at least of the peripheral extent of the outer wall thereof, the inwardly extending lower leg of the section comprising support means having a horizontal upper surface thereto.

The lowermost position of the cover may be determined by abutment of the cover with the upper surface of the support means, the first temporary inner frame also seating on the upper surface of the support means to surround the cover in its lowermost position and to close the outer frame, the second inner frame seating on the upper surface of the support means to determine the higher position of the cover.

Alternatively, the first temporary frame may seat on the upper surface of the support means and may be configured to receive thereon the cover, typically a gully grate, to determine the lowermost position of the cover, the second inner frame again seating on the upper surface of the support means to determine the higher position of the cover.

The invention is particularly suited to assemblies incorporating covers of generally rectangular shape, it being preferred that the inwardly extending support means are provided at the corner regions only of the outer frame.

Accordingly the first and second inner frames will include downwardly extending leg portions at the corner regions thereof adapted to seat on, and co-operate with, the support means on the outer frame, the extents of the first and second inner frames between the corner regions being of lesser depth than the corner regions.

Conveniently the outer frame and the second inner frame include adjustable attachment means operable to effect a connection between the sidewalls thereof once the inner frame is located at a desired level relative to the outer frame, for example one or more vertical slots in one of the frames and a locking bolt on the other frame.

DESCRIPTION OF THE PREFERRED EMBODIMENTS

Figure 1:
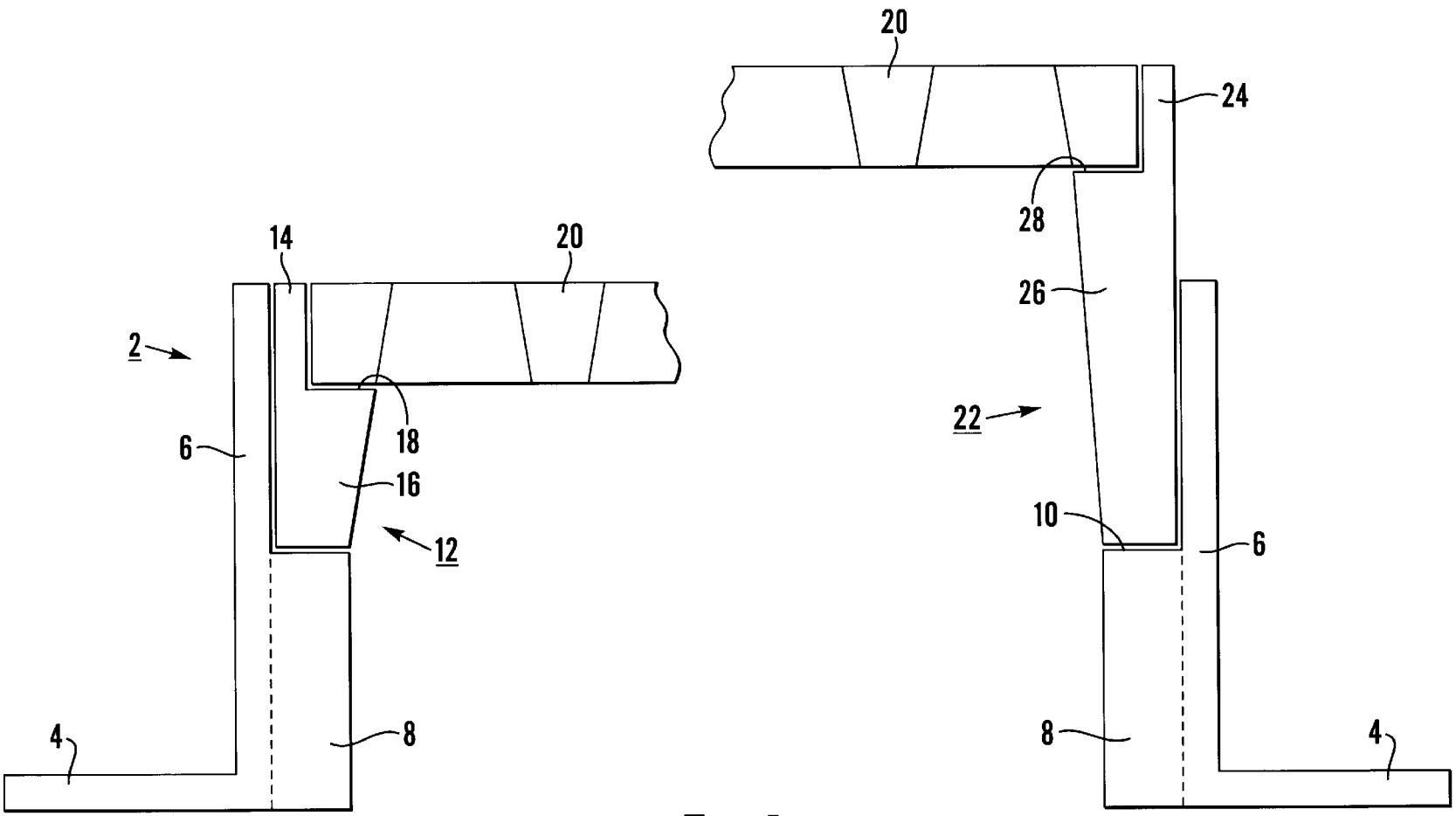
FIG. 1 is a vertical section through a first assembly according to the invention at a corner thereof, the left hand side of which shows the cover in its lowermost position, and the right hand side of which shows the cover in a higher position.

Referring to FIG. 1, the illustrated assembly includes a generally rectangular outer frame indicated generally at 2 for location in the foundations of a road under construction to surround a gully pot therein.

The outer frame includes an outwardly projecting peripheral flange 4 upstanding from which is a sidewall 6 defining the frame, and typically 100 mm high. Diagonally across each corner of the frame 2, and integrally formed with the sidewall 6, is an inwardly projecting support portion 8 having a horizontal upper surface or ledge 10 thereon located typically 50 mm above the base of the frame 2, and whereby the sidewall 6 projects 50 mm above the ledge 10.

The assembly includes a temporary inner frame indicated generally at 12 having a depth of 50 mm and adapted to seat on the ledges 10 at the corners of the outer frame 2.

The inner frame 12 comprises an upstanding peripheral wall 14 and, across the corners thereof, an inwardly projecting support portion 16 having a horizontal upper surface or ledge 18 thereon.

The inner frame 12 and the ledges 18 are configured to receive thereon and support a gully grate 20 for the assembly whereby the upper surface of the grate 20 is level with the upper ends of the aligned sidewalls 6,14 of the outer and inner frames 2,12 respectively, this being the anticipated level of the base course of the road.

Thus it will be appreciated that, after construction of the base course and with the grate 20 in position, the top surface of the grate is level with, to form a continuation of, the surface of the base course.

Before laying the wearing course, it is necessary to raise the grate 20 to the anticipated level of said wearing course, and this is achieved as follows.

The grate 20 is removed from the inner frame 12, and the inner frame 12 is removed from the outer frame 2. A second, permanent inner frame indicated generally at 22 is positioned within the outer frame 2. The inner frame 22 comprises an upstanding peripheral wall 24 and, across the corners thereof, an inwardly projecting support portion 26 having an upper surface or ledge 28 thereon.

The inner frame 22 is typically 90 mm deep whereby, with the frame 22 supported on the ledge 10 of the outer frame 2, the upper end of the inner frame 22 is located at the anticipated surface level of a 40 mm thick wearing course, 140 mm above the base of the outer frame 2.

The ledges 28 on the inner frame 22 are so positioned as to support the grate 20 thereon whereby the upper surface of the grate 20 is also level with the anticipated surface level of the wearing course.

Clearly the height of the inner frame 22 can be chosen dependent upon the depth of wearing course to be used, or packing could be provided between the ledges 10 on the outer frame 2 and the lower ends of the support portions 26 of the inner frame 22.

Referring to FIGS. 2 to 7 there is shown an assembly including a rectangular outer frame indicated generally at 30 for location in the foundations of the road under construction to surround a manhole therein.

The general configuration of the frame 30 is similar to that of FIG. 1 except that the solid support portions 8 of FIG. 1 are replaced by hollow U-section profiles defined by upstanding walls 32 inwardly of the sidewall 6 and terminating midway up the sidewall 6, typically 50 mm above the base of the outer frame 30.

Figure 2:
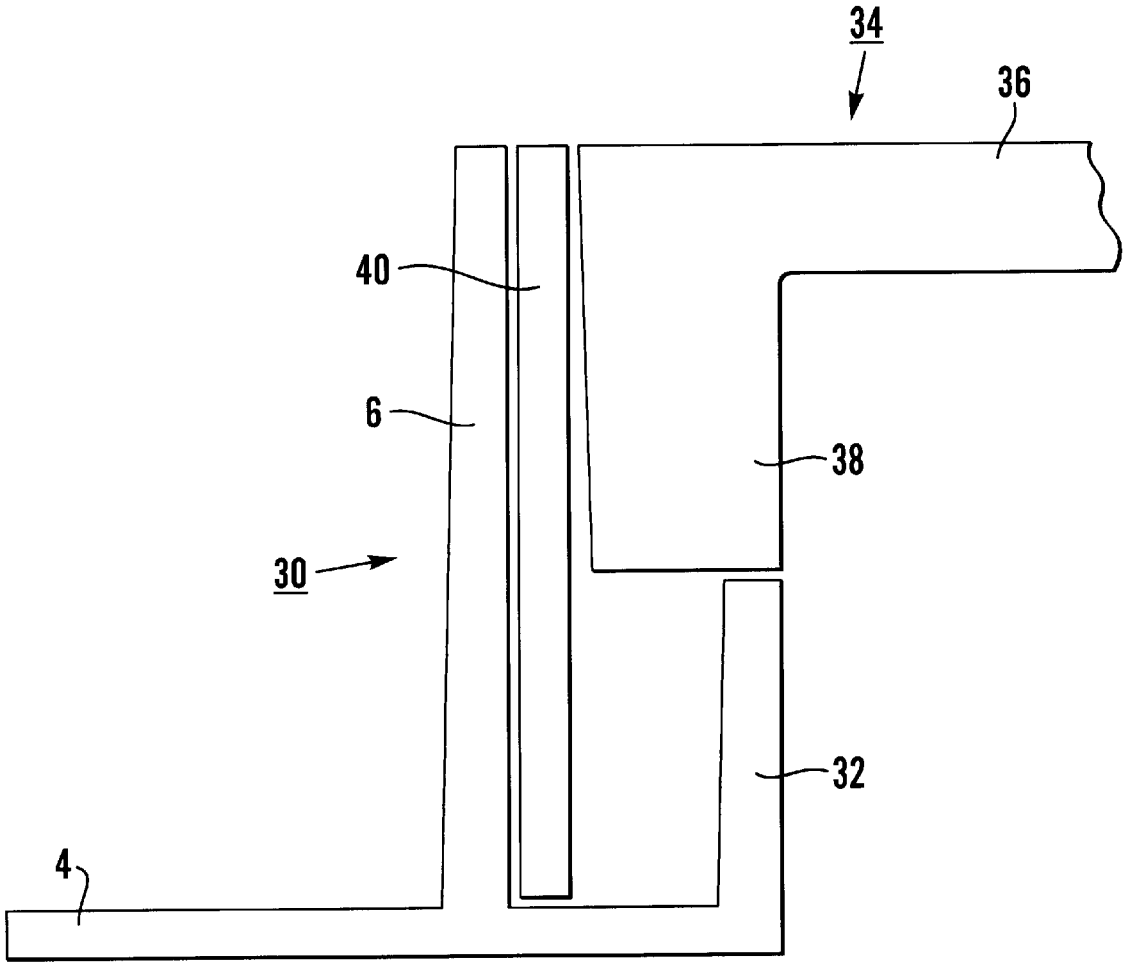
FIGS. 2, 3 and 4 are vertical sections through part of a second assembly according to the invention at a corner thereof in different stages of assembly.

A manhole cover is indicated generally at 34 and includes a rectangular top plate 36 and an integral depending peripheral flange 38. Closure of the assembly is effected by locating the cover 34 in the outer frame 30 to seat on and to be supported by the upper ends of the walls 32 as shown in FIG. 2. In this position of the cover 34 there is an annular space between the cover and the upstanding wall 6 of the outer frame 30, and this space is filled by a temporary inner frame 40 supported on the base of the outer frame 30 which serves to locate the cover in position and to prevent the ingress of undesirable material into the assembly.

The locations of the upper ends of the walls 32 ensures that the upper surface of the cover 34 is level with the upper end of the wall 6 and with the anticipated level of the base course of the road, as is the upper end of the temporary frame 40.

Thus it will be appreciated that, after construction of the base course and with the cover 34 in position, the top surface of the plate 36 is level with, to form a continuation of, the surface of the base course.

Before laying the wearing course, it is necessary to raise the cover 34 to the anticipated level of said wearing course, and this is achieved as follows.

Figure 3:
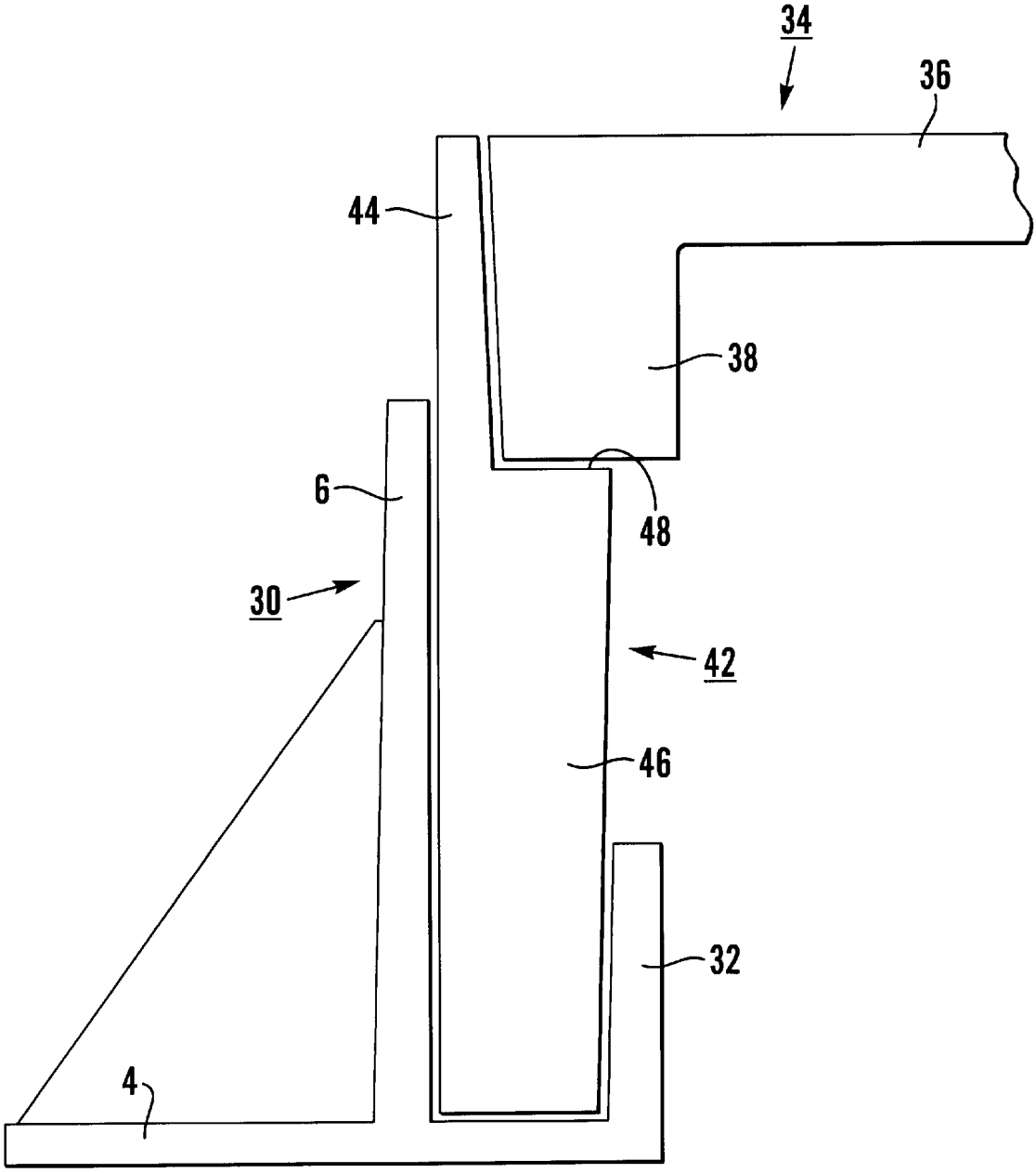

The cover 34 is removed from within the outer frame 30, as is the temporary inner frame 40. A second permanent inner frame indicated generally at 42 is positioned within the outer frame 30 as shown in FIG. 3. The inner frame 42 comprises an upstanding peripheral wall 44 and, across each corner thereof, an increased thickness support portion 46 having an upper surface or ledge 48 thereon and adapted to be received within an associated one of the U-section profiles at the corners of the outer frame 30.

The inner frame 42 is typically 140 mm high with the ledge 48 located 50 mm from the top thereof, the depth of the cover 34.

Thus, with the inner frame 42 seating in the outer frame 30, and with the cover 34 supported on the ledges 48 of the inner frame 42, the upper end of the wall 44 and the upper surface of the top plate 36 of the cover 34 are positioned at the anticipated level of a wearing course 40 mm thick.

Figure 4:
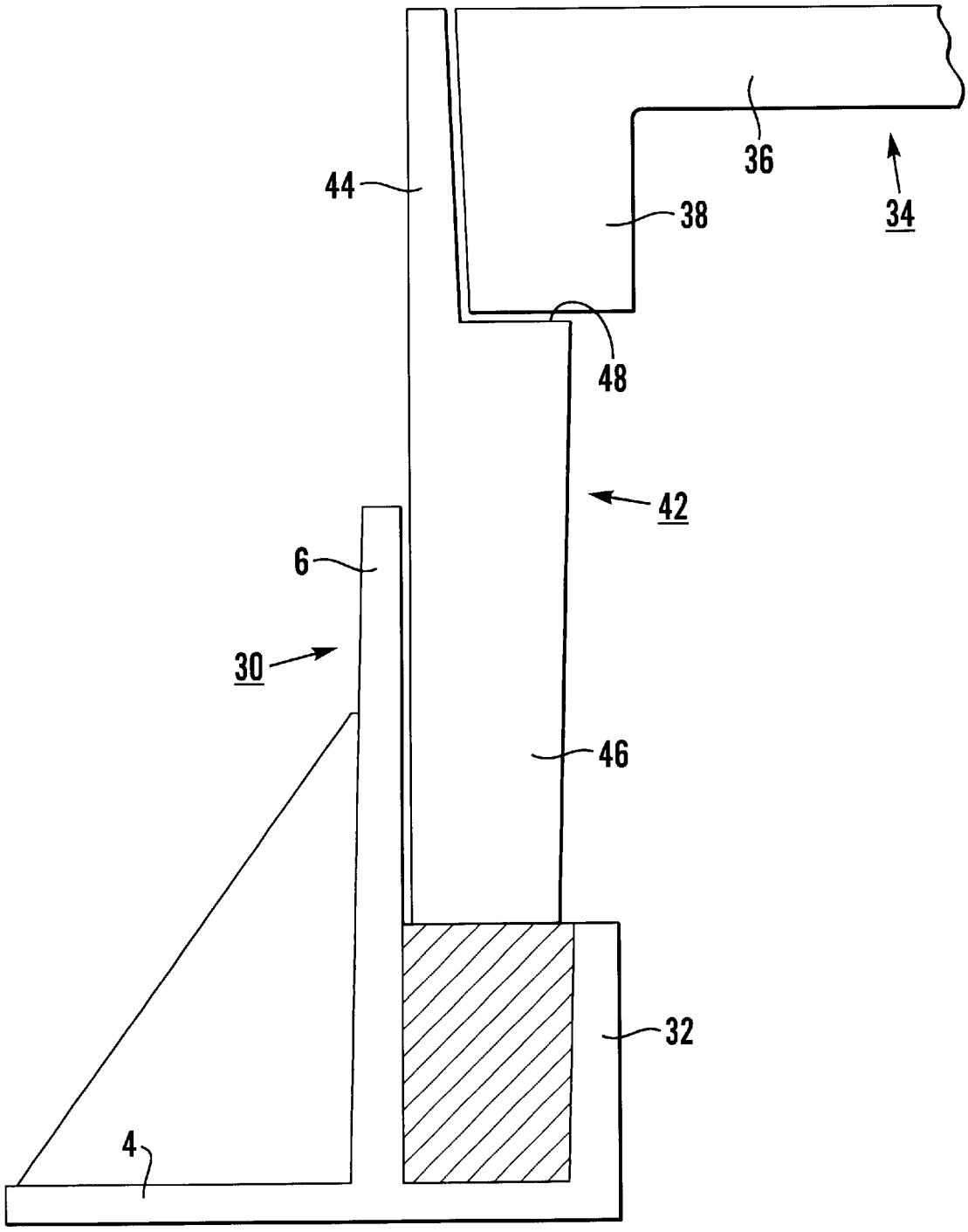

If a thicker wearing course is to be provided, it will be appreciated that a taller inner frame 42 may be provided, or the illustrated frame 42 may be raised as shown in FIG. 4 by inserting support means, for example a settable filler material or support blocks, in the U-sections of the outer frame 30, to achieve the desired level for the cover 34.

Figure 5:
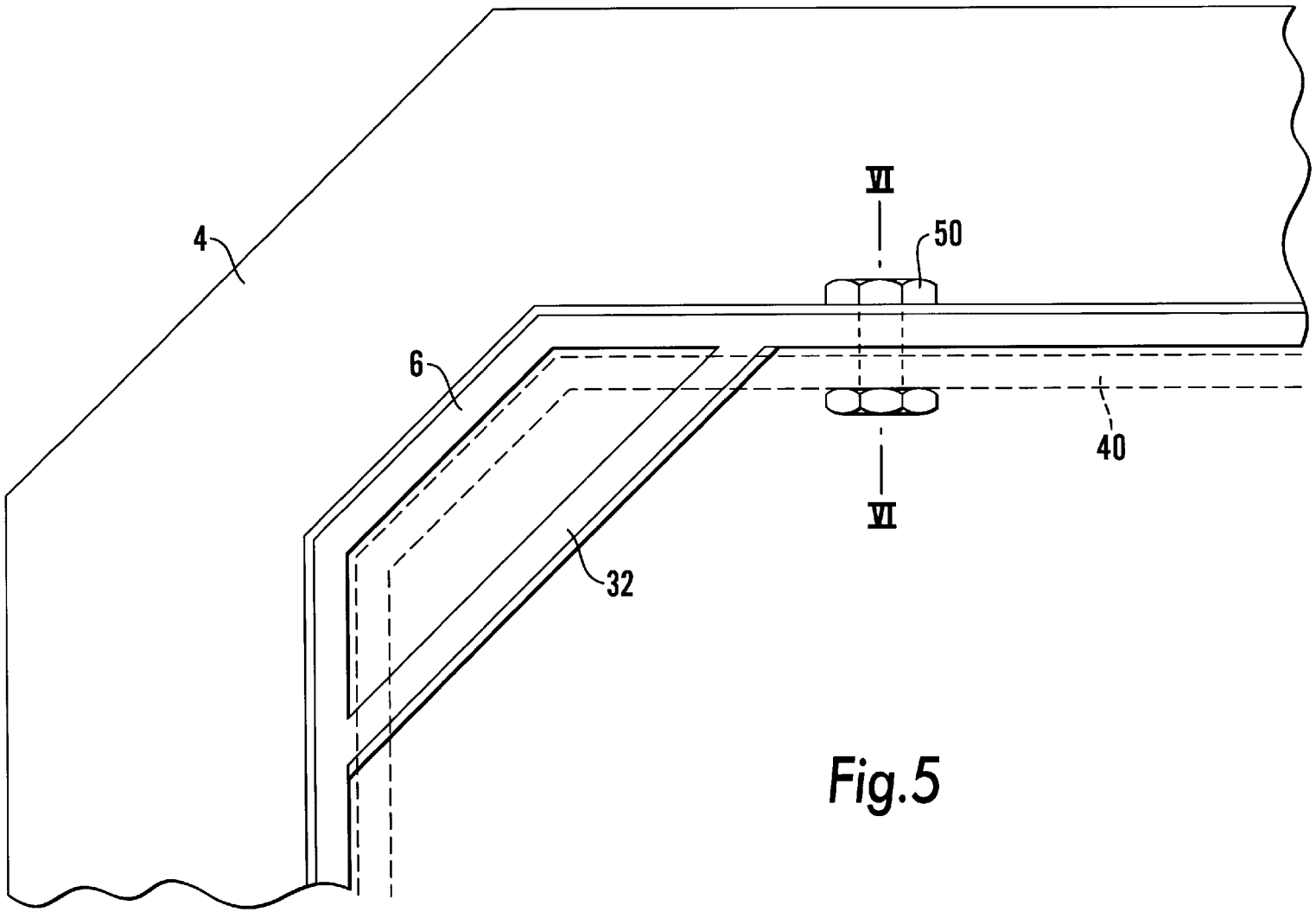
FIG. 5 is a plan view from above of the corner of the outer frame of the assembly of FIGS. 2 to 4.

FIG. 5 shows the U-section profile of the outer frame 30 defined between the sidewall 6 of the frame 30 and the upstanding wall 32 at the corners of the frame 30, the line of the temporary inner frame 40 being shown in dotted lines.

Figure 6:
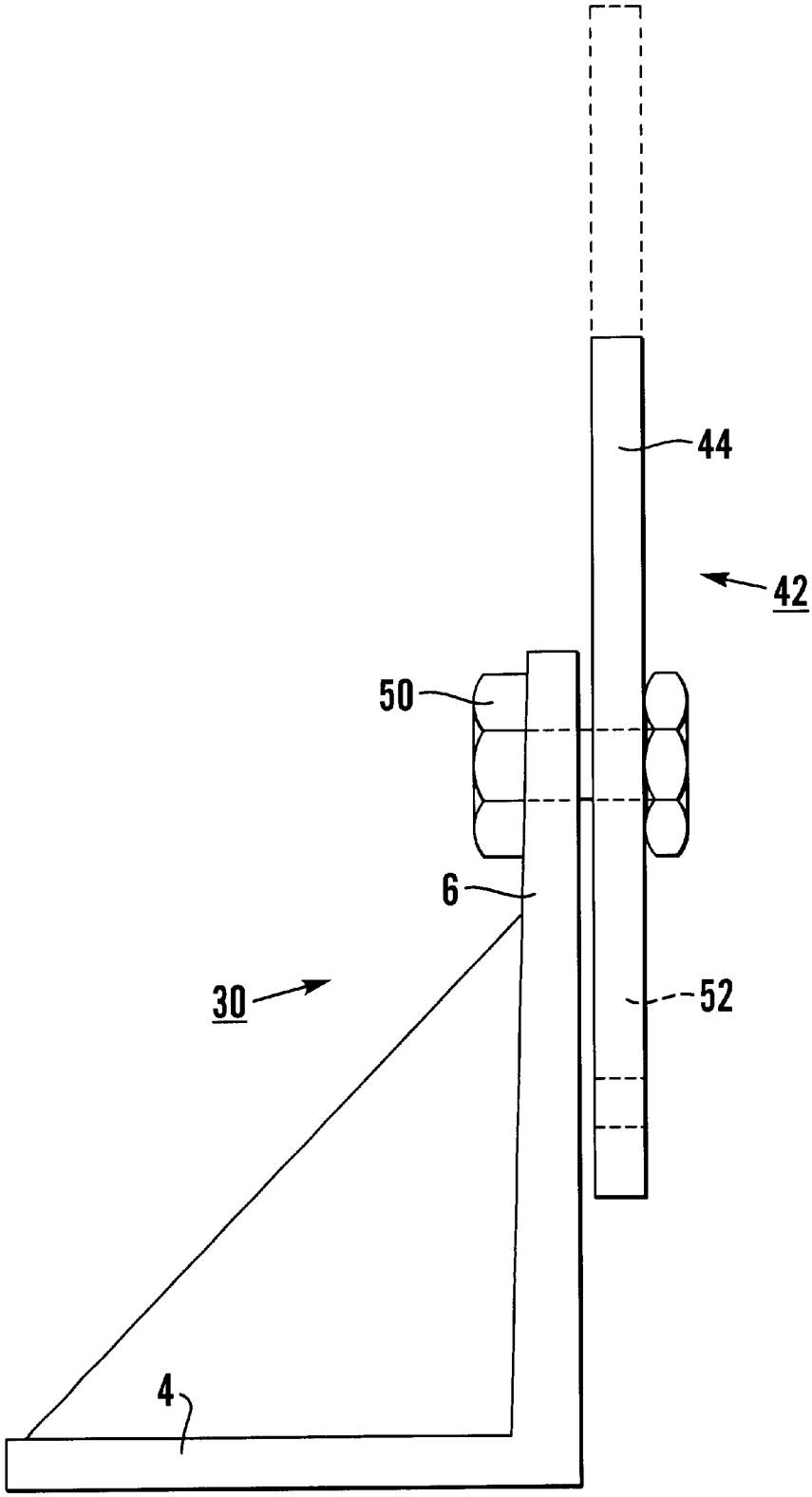
FIG. 6 is a section on the line VI—VI in FIG. 5.
Figure 7:
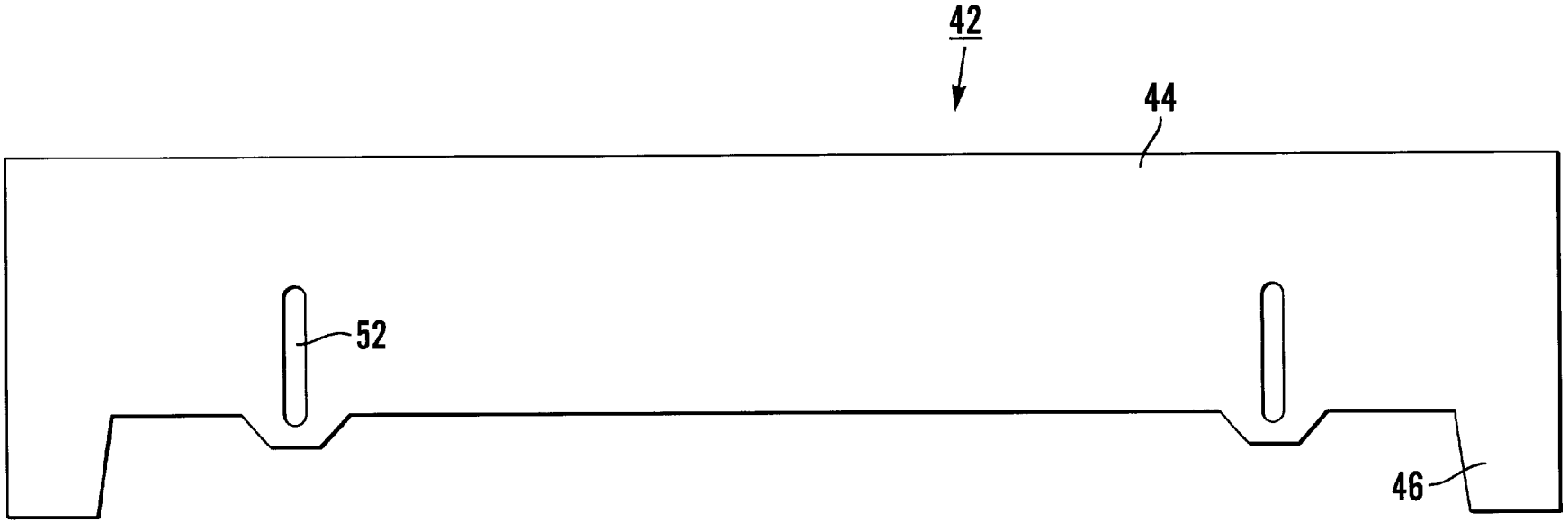
FIG. 7 is a view of one side of the second inner frame of the assembly of FIGS. 2 to 4.

FIGS. 5 to 7 show one of a number of connection means provided on the outer frame 30, in the form of a nut and bolt combination 50 extending through a hole in the side extent of the wall 6, for securing the inner frame 42 to the outer frame 30 once the final position of the inner frame 42 is determined. The connection means further include, for each nut and bolt combination 50, a vertical slot 52 in a side extent of the wall 44 of the inner frame 42 which permits vertical adjustment of the frame 42 relative to the outer frame 30, the combination 50 being tightened once the final position of the frame is achieved, thereby supplementing the positioning of the frame 42 provided by the portions 46 thereof.

The combination 50/slot 52 may typically provide for up to 40 mm vertical adjustment.

Figure 9:
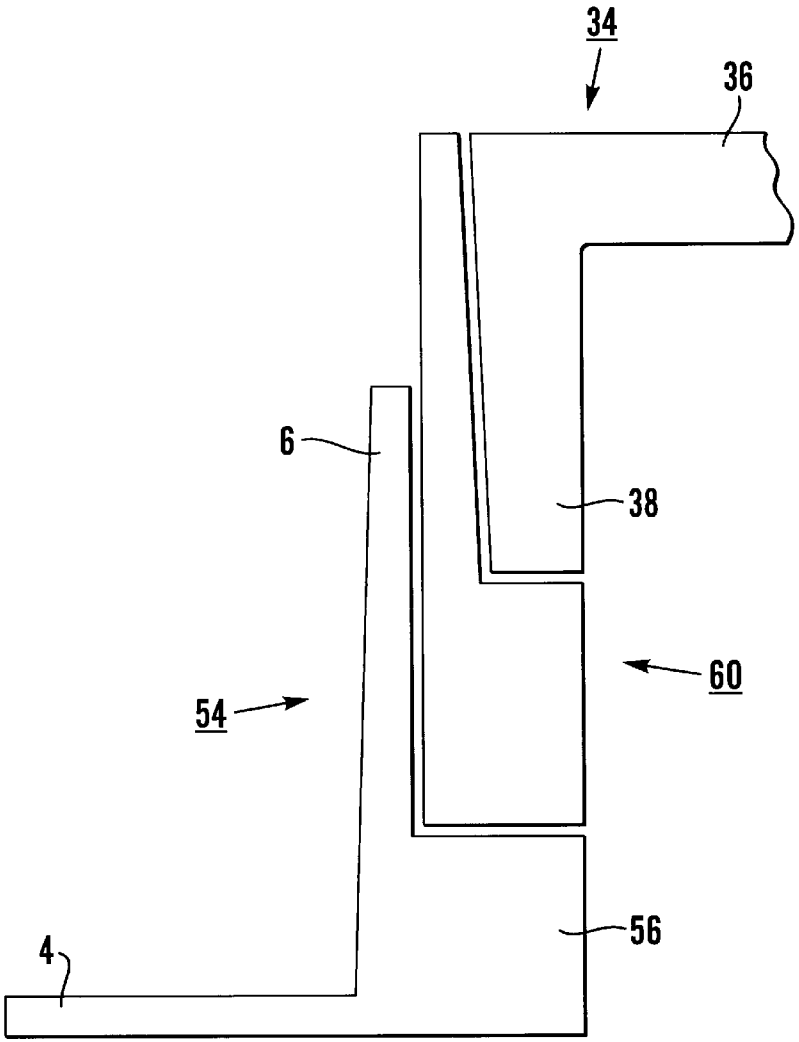
FIGS. 8 and 9 are vertical sections through part of a third assembly according to the invention at a corner thereof with the cover in its lowermost and higher positions respectively.
Figure 8:
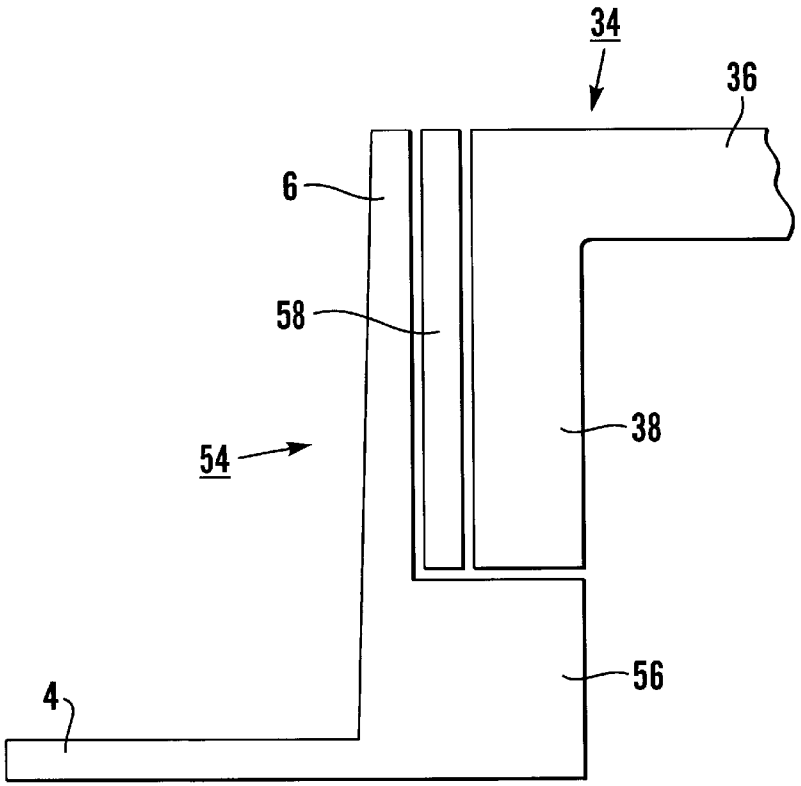

Referring to FIGS. 8 and 9, there is shown an assembly similar to that of FIGS. 2 to 7 but in which the outer frame, referenced 54, includes, at the corners thereof, a solid support portion 56 similar to that of the outer frame 2 of FIG. 1. As in the embodiment of FIGS. 2 to 7, the cover 34 of FIGS. 8 and 9 is supported in its lowermost position by abutment with the outer frame 54, more particularly with the support portion 56, with the temporary inner frame, referenced 58, also seating on the support portion 56 to fill the space between the cover 34 and the outer frame 54.

The higher position of the cover 34 is determined by a permanent inner frame referenced 60 similar to the inner frame 42 having increased thickness support portions 62 at the corners thereof which seat on the support portions 56 of the outer frame 54. The function and operation of this embodiment conforms with that of the embodiment of FIGS. 2 to 7.

In all embodiments, the provision of separate temporary and permanent inner frames associated with the base course level and the wearing course level of the road respectively ensures that all British Standard regulations relating to the extent of vertical overlaps of components can be readily met, whilst at the same time enabling accommodation of a variety of thicknesses of wearing courses in excess of the conventional thickness of 40 mm.

Clearly the precise construction and configuration of the various frames can be altered from that described and illustrated without departing from the scope of the basic invention, while the material of the temporary frame can be chosen to suit particular requirements. Where this temporary frame supports, as in FIG. 1, the material may be steel. In non-supporting situations as shown in FIGS. 2 to 9, the temporary frames may be of relatively cheap, lightweight material such as plastic.

It will be appreciated that the temporary frames are simple to remove prior to raising the cover to the wearing course level, and can be stored for subsequent usage, the overall invention providing a high degree of flexibility and adjustment for the final wearing course level such as may be required for example when block paving is superimposed on the wearing course.

What I claim and desire to secure by Letters Patent is:

1. A road gully or inspection cover assembly system which is adjustable to co-operate with a base course level of a road and subsequently with a wearing course level of the road which is higher than the base course level, said assembly system comprising:

a cover which is of generally rectangular shape, an outer frame of generally rectangular share having (a) an upstanding outer wall having lower regions, and (b) integrally formed support means extending inwardly from the lower regions of the outer wall at corner regions only of the outer frame, a first temporary inner frame for temporary location within the outer frame and support thereby, the outer frame and the first temporary inner frame co-operating to support the cover in a first lowermost position associated with the base course level of the road, and a second inner frame of generally rectangle shape having a height which is greater than a height of said first inner frame and which, on removal of and substitution for the first inner frame from within the outer frame is located within and is supported by the support means of the outer frame whereby the second inner frame co-operates with the outer frame to support the cover at a second higher position associated with the higher wearing course level of the road, wherein said second inner frame includes downwardly extending leg portions at corner regions thereof adapted to seat on, and co-operate with, the support means on the outer frame and wherein the second inner frame between the corner regions extends downward less than the leg portions at the corner regions.

2. An assembly system as claimed in claim 1, including a plurality of said second inner frames having different heights respectively associated with different second higher positions of the cover.

3. An assembly system as claimed in claim 1 in which a position of the second inner frame relative to the outer frame is vertically adjustable.

4. An assembly system as claimed in claim 3, and further including selectively variable support means reacting between the outer frame and an underside of the second inner frame.

5. An assembly system as claimed in claim 1:

wherein the corner regions of the outer frame includes upwardly-open channel sections as viewed in a transverse cross section, each said channel section being configured to define an upstanding inner wall, which said upstanding inner walls comprise said support means, wherein the first lowermost position of the cover is determined by an abutment of the cover with the upstanding inner walls, wherein the first temporary inner frame surrounds the cover in the first lowermost position to close a hollow interior of the outer frame, and wherein the leg portions of the second inner frame are received within the channel sections of the outer frame to determine the second higher position of the cover.

6. As assembly system as claimed in claim 1:

wherein the corner regions of the outer frame are of substantially L-shape in transverse section and wherein inwardly extending lower legs of the L-shaped parts have horizontal upper surfaces comprising said support means.

7. An assembly system as claimed in claim 6:

wherein the first lowermost position of the cover is determined by abutment of the cover with the upper surfaces of the lower legs, wherein the first temporary inner frame also seats on the upper surfaces of the lower legs to surround the cover in the first lowermost position and to close the outer frame, and wherein the second inner frame seats on the upper surfaces of the lower legs to determine the second higher position of the cover.

8. An assembly system as claimed in claim 6:

wherein the first temporary inner frame seats on the upper surfaces of the lower legs and is configured to receive therein the cover to determine the first lowermost position of the cover, and wherein the second inner frame seats on the upper surfaces of the lower legs to determine the second higher position of the cover.

9. An assembly system as claimed in claim 1:

wherein the first inner frames is of generally rectangular shape and includes downwardly extending leg portions at corner regions thereof adapted to seat on, and co-operate with, the support means on the outer frame, and wherein the first inner frames between the corner regions thereof extend downward less than the leg portions thereof at the corner regions.

10. An assembly system as claimed in claim 1, wherein the outer frame and the second inner frame include adjustable attachment means operable to effect a connection between respective sidewalls thereof once the second inner frame is located at a desired level relative to the outer frame.

11. An assembly system as claimed in claim 10, wherein the attachment means comprise one or more vertical slots in one of the outer frame and second inner frame and a locking bolt on the other frame.

* * * * *